US005331814A

United States Patent [19]

Sandelis

[11] Patent Number: 5,331,814

[45] Date of Patent: Jul. 26, 1994

[54] GAS TURBINE COMBUSTION CHAMBER WITH MULTIPLE FUEL INJECTOR ARRAYS

[75] Inventor: Denis J. M. Sandelis, Nangis, France

[73] Assignee: Societe Nationale d'Etude et de Construction de Moteurs d'Aviation (S.N.E.C.M.A.), Paris, France

[21] Appl. No.: 92,530

[22] Filed: Jul. 16, 1993

[30] Foreign Application Priority Data

Aug. 5, 1992 [FR] France ..... 92 09687

[51] Int. Cl.[5] ..... F23R 3/34; F23R 3/46

[52] U.S. Cl. ..... 60/747; 60/733

[58] Field of Search ..... 60/747, 746, 39.36, 60/39.06, 39.142, 733, 739, 738, 743

[56] References Cited

U.S. PATENT DOCUMENTS

| | | | |
|---|---|---|---|
| 2,984,970 | 5/1961 | Bertaux et al. | 60/746 |
| 3,720,058 | 3/1973 | Collinson et al. | 60/746 |
| 3,910,035 | 10/1975 | Juhasz et al. | 60/746 |
| 4,027,473 | 6/1977 | Baker | 60/243 |
| 4,455,840 | 6/1984 | Matt et al. | 60/743 |
| 4,499,735 | 2/1985 | Moore et al. | 60/746 |
| 4,991,398 | 2/1991 | Clark et al. | 60/748 |
| 5,036,657 | 8/1991 | Seto et al. | 60/746 |
| 5,235,814 | 8/1993 | Leonard | 60/738 |

FOREIGN PATENT DOCUMENTS

| | | |
|---|---|---|
| 942251 | 2/1949 | France . |
| 1008197 | 5/1952 | France . |
| 1130091 | 1/1957 | France . |
| 2010408 | 6/1979 | United Kingdom . |
| 2013788 | 8/1979 | United Kingdom . |

OTHER PUBLICATIONS

The Reduction of Gas Turbine Idle Emissions by Fuel Zoning for Compressor Bleed, *Journal of Engineering for Industry*, Aug. 1974, pp. 307-310.

*Primary Examiner*—Richard A. Bertsch
*Assistant Examiner*—Timothy S. Thorpe
*Attorney, Agent, or Firm*—Bacon & Thomas

[57] ABSTRACT

A gas turbine engine combustion chamber is disclosed having multiple sets of fuel injectors. A set of first fuel injectors are arranged in two radially inner and outer generally circular first arrays such that the fuel injectors of one array are located circumferentially between the fuel injectors of the other array. The combustion chamber also includes a set of second fuel injectors which are also arranged in two generally circular, radially inner and outer arrays such that, in each array, the second fuel injectors are located circumferentially between the first fuel injectors. In a circumferential direction, the positions of the first and second fuel injectors vary between the radially outward array and the radially inward array. One set of fuel injectors may operate under idle and low power operating conditions, while the other set of fuel injectors inject fuel into the combustion chamber during full power take off or cruise operations. Since the radial positions of adjacent fuel injectors in each set vary in a radial direction around the circumference of the combustion chamber, the radial temperature variations are eliminated.

11 Claims, 3 Drawing Sheets

GAS TURBINE COMBUSTION CHAMBER WITH MULTIPLE FUEL INJECTOR ARRAYS

BACKGROUND OF THE INVENTION

The present invention relates to a gas turbine combustion chamber, more particularly such a combustion chamber having multiple arrays of fuel injectors.

It is known to provide gas turbine engine combustion chambers with two sets of fuel injectors whereby one set, known as the pilot injectors, inject fuel into the combustion chamber during idling and low power engine operation, while the injectors of the other set, known as the take off or main injectors, inject fuel into the combustion chamber during full power, take off, or cruising mode of operation of the engine.

Typically, such sets of fuel injectors are arranged such that all of the injectors of one set, in an annular combustion chamber, are located either radially outwardly, or radially inwardly of all of the injectors of the other set. This arrangement of the sets of fuel injectors causes many drawbacks, one of which is the radial temperature variation of the exhaust gases emanating from the combustion chamber. Often, the pilot fuel injectors are located radially outwardly of the main injectors and, if the pilot injectors alone are operating, the exit temperatures of the combustion gases at the exit of the combustion chamber may vary between 900° -1,800° K. between the radially inner and the radially outer portions of the combustion chamber exhaust. Such temperature variations also cause radial temperature differential between the root and the tip of a gas turbine blade typically located at the exit of the combustion chamber. This radial temperature variation causes a reduction in efficiency of the gas turbine.

SUMMARY OF THE INVENTION

A gas turbine engine combustion chamber is disclosed having multiple sets of fuel injectors. A set of first fuel injectors are arranged in two radially inner and outer generally circular first arrays such that the fuel injectors of one array are located circumferentially between the fuel injectors of the other array.

The combustion chamber also includes a set of second fuel injectors which are also arranged in two generally circular, radially inner and outer arrays such that, in each array, the second fuel injectors are located circumferentially between the first fuel injectors. Thus, a line extending radially from a central axis about which the annular combustion chamber extends will pass through a first and a second fuel injector. In the fuel injector orientation according to the invention, the radial positions of circumferentially adjacent fuel injectors are reversed e.g. along a first radial line, the first fuel injector may be located in the radial inward position while the second fuel injector is located in a radial outward position, while in an adjacent radial line, the positions of the first and second fuel injectors are reversed. Thus, in a circumferential direction, the positions of the first and second fuel injectors vary between the radially outward array and the radially inward array.

The sets of first and second fuel injectors operate under different engine operating modes and may operate similarly to the aforementioned pilot injectors and take off or main injectors. One set of fuel injectors may operate under idle and low power operating conditions, while the other set of fuel injectors inject fuel into the combustion chamber during full power take off or cruise operations. However, since the radial positions of adjacent fuel injectors in each set vary in a radial direction around the circumference of the combustion chamber, the radial temperature variations of the prior art devices are eliminated, thereby reducing the radial temperature differences in the gas turbine blades and increasing the efficiency of the gas turbine.

A wall extends around the fuel injectors of one set to define a chamber into which the injector injects fuel. The wall separates the fuel jet injected by the fuel injector into the chamber from the fuel jets injected into the combustion chamber by the other fuel injectors. The wall extends radially inwardly from one of the annular walls bounding the inner and outer sides of the combustion chamber to a distance approximately midway between the circles of the fuel injector arrays.

A second wall is located spaced from, but extends generally parallel to the wall so as to define a space between them. The space communicates with an oxidizer supply and the walls define a plurality of openings through which the oxidizer may pass into the combustion chamber and into the chamber defined by the first wall. If the fuel injectors are equipped with known swirling devices which induce a generally circular swirling motion to the fuel spray injected into the combustion chamber, the holes defined by the first and second walls are oriented such that the oxidizer passing through these holes complements the circular swirling movement of the fuel sprays.

DETAILED DESCRIPTION OF THE PREFERRED EMBODIMENT

Figure 1:
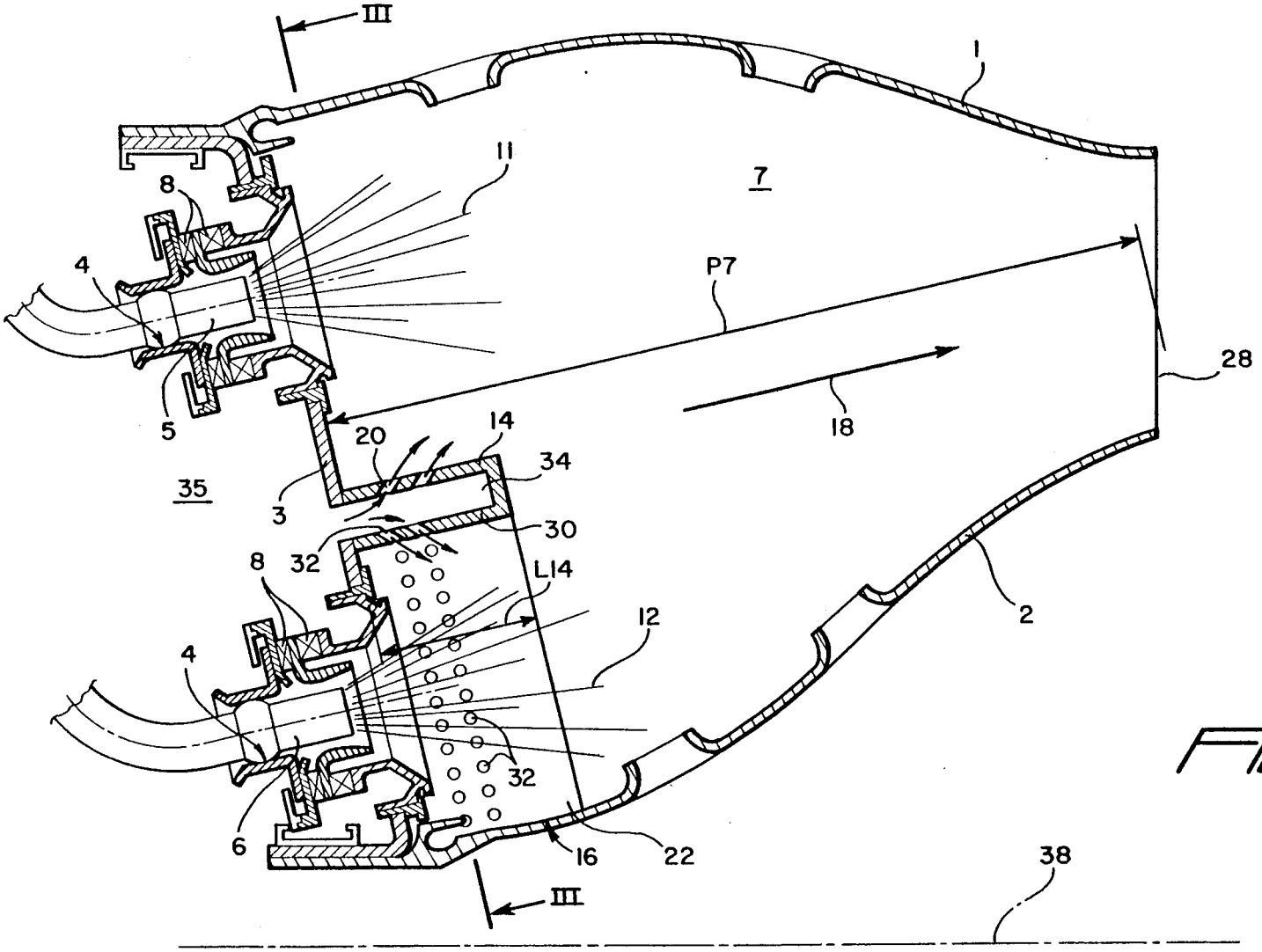
FIG. 1 is a partial, axial cross-section taken along line I—I of FIG. 3 illustrating a combustion chamber according to the present invention.

The combustion chamber according to the present invention has a generally annular configuration which extends about a central axis 38 of the gas turbine engine and is bounded on opposite sides by external annular wall 1 and internal annular wall 2. An upstream end wall 3 extends generally transversely to the central axis and interconnects the external and internal annular walls 1 and 2. Upstream end 3 defines a plurality of openings 4 through which are mounted one of the two fuel injectors 5 and 6. Fuel injectors 5 may be pilot fuel injectors used during idle and low power gas turbine operation, while fuel injectors 6 are the main or take off injectors designed for use during full power operation of the engine, such as during aircraft take off or cruising.

Figure 3:
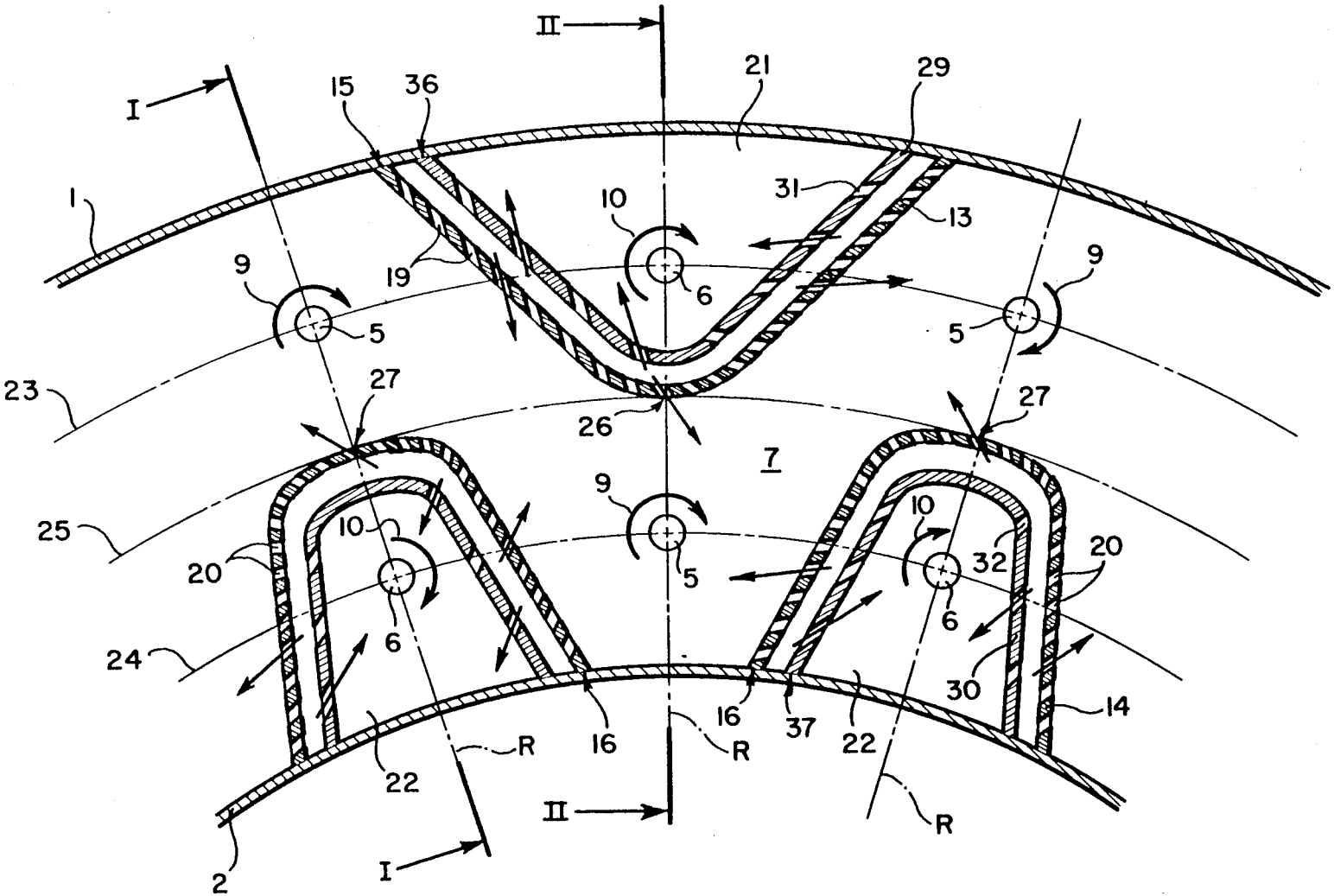
FIG. 3 is a partial, transverse cross-section taken along III—III in FIG. 1 illustrating the combustion chamber according to the present invention.

Each opening 4 is associated with an oxidizer intake to the combustion chamber 7 which may comprise known annular guides 8, called intake swirlers, which enable the oxidizer to swirl in a generally circular fashion around fuel injectors 5 and 6 in paths schematically illustrated by arrows 9 and 10 in FIG. 3. Each fuel injector 5 and 6 sprays a generally conical fuel jet 11 and 12 into the combustion chamber 7.

Figure 2:
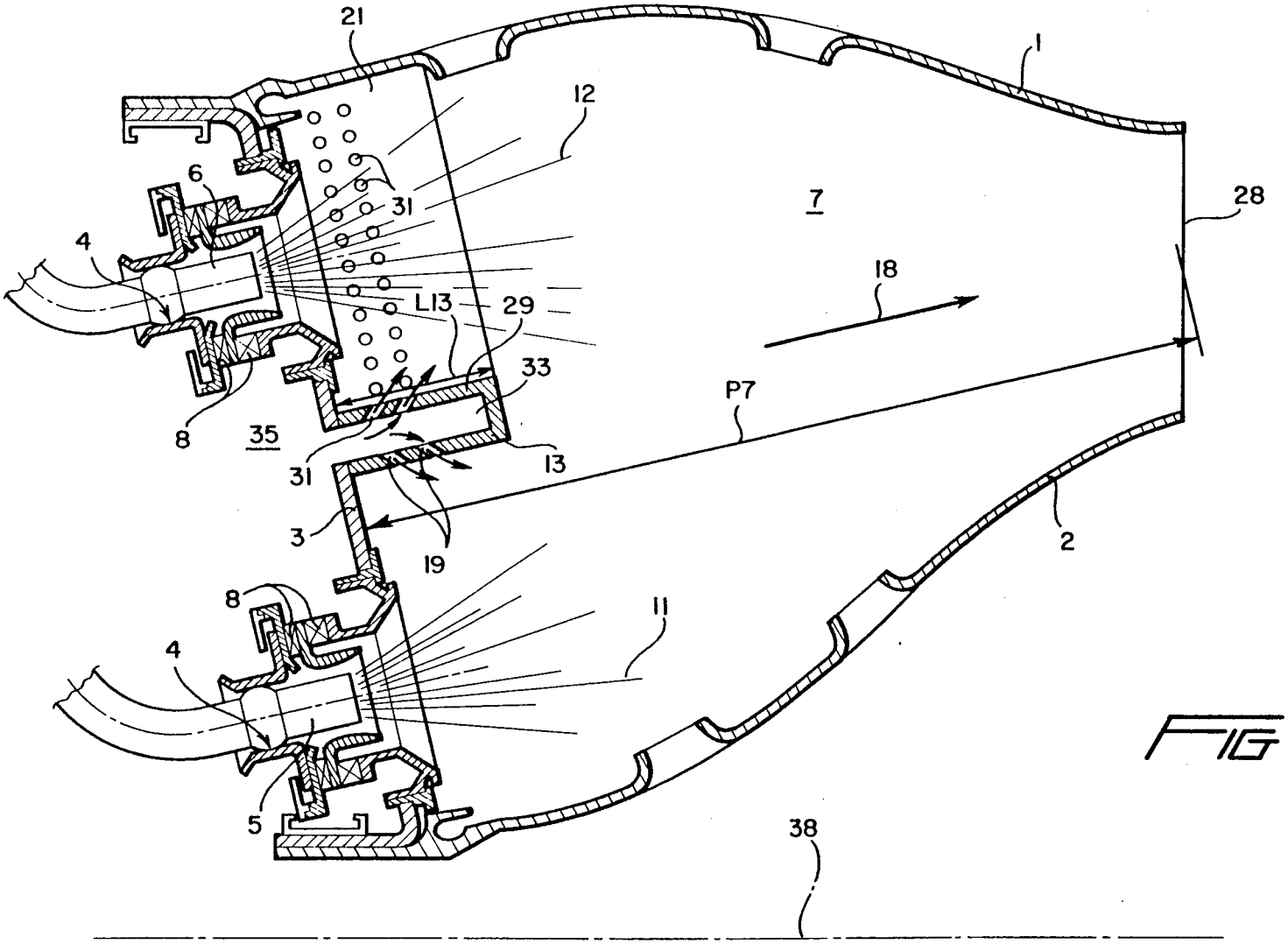
FIG. 2 is a partial, axial cross-section taken along line II—II in FIG. III illustrating the combustion chamber of FIG. 1.

First walls 13 and 14 extend around fuel injectors 6 and define a chamber into which the fuel injector sprays fuel. The walls 13 and 14 extend axially into the combustion chamber from upstream end wall 3 and are attached to annular walls 1 or 2 at edges 15 and 16, respectively. The walls 13 and 14 extend substantially parallel to the gas flow direction, illustrated by arrow 18 in FIGS. 1 and 2, inside the combustion chamber. The lengths L13 and L14 of walls 13 and 14 are substantially less than the axial length P7 of the combustion chamber 7. Preferably, the length L13 is equal to length L14 and may be between 0.15 P7 and 0.30 P7. The walls 13 and 14 have lengths which are selected to initially insulate the fuel sprays 11 from the fuel sprays 12.

Second walls 29 and 30 are mounted adjacent to and extend substantially parallel to the walls 13 and 14, respectively so as to define spaces 33 and 34 therebetween. Spaces 33 and 34 communicate with space 35, located upstream of the combustion chamber end 3 which may contain an oxidizer. Walls 29 and 30 extend into the combustion chamber from upstream end wall 3 and are attached to the annular walls 1 and 2 via edges 36 and 37. Second walls 29 and 30 define a plurality of holes 31 and 32, respectively which allow communication between the spaces 33 and 34 with the chambers 21 and 22 into which the fuel injectors 6 inject fuel.

First walls 13 and 14 define a plurality of holes 19 and 20 which extend obliquely through the first walls and which also communicate with spaces 33 and 34 as well as with the combustion chamber 7. The orientation of the holes 19 and 20 is selected such that cooling air or oxidizer passing through the holes from spaces 33 and 34 flows in directions which are compatible with the directions of the oxidizer swirls 9. Walls 13 and 14 also enhance the swirling effect of the adjacent swirlers due to the orientation of the openings 19 and 20.

As can best be seen in FIG. 3, the first fuel injectors 5 are located in radially displaced circular arrays extending along circles 23 and 24. Circumferentially adjacent fuel injectors 5 are alternately located on circles 23 and 24 such that the fuel injector 5 on one of the circles 23 or 24 is located circumferentially midway between adjacent first fuel injectors 5 on the other circle. As can be seen in FIG. 3, the fuel injector 5 located on circle 24 is circumferentially between the fuel injectors 5 located on circle 23.

Similarly, the second fuel injectors 6 are also located on circles 23 and 24 and, in a circumferential direction, are located approximately midway between fuel injectors 5 on the same circle. Thus, as also illustrated in FIG. 3, fuel injector 6 on circle 23 is approximately midway between the fuel injectors 5 on circle 23, and is also approximately midway between the fuel injectors 6 located on circle 24. The pattern partially illustrated in FIG. 3 continues around the entire circumference of the annular combustion chamber 7.

In the orientation of the fuel injectors according to the present invention, a radial line R extending from a central axis 38 about which the annular combustion chamber 7 extends will pass through a pair of fuel injectors 5 and 6. However, in each circumferentially adjacent radial line R, the radially inner and radially outer positions of the fuel injectors 5 and 6 will be reversed. If fuel injector 5 is located radially outwardly and fuel injector 6 is located radially inwardly along a given radial line R, on the next adjacent radial line R the radial positions of the fuel injectors will be reversed such that fuel injector 6 is located radially outwardly of fuel injector 5.

Thus, even when only a single set of fuel injectors (either fuel injectors 5 or fuel injectors 6) are operating, the radially and circumferentially staggered array of the operating injectors will form high temperature gas streams having very little radial temperature variation in the combustion chamber 7. The radially alternating positions of the operating fuel injectors form gas streams which mix inside the combustion chamber 7 and arrive at the combustion chamber outlet 28 as a gas flow having very little, if any, temperature variation in the radial direction. Even if fuel injectors 5 and 6 are operating simultaneously, the radial temperature consistency of the gases passing through outlet 28 is not deleteriously effected.

Although the invention has been described in conjunction with an annular gas turbine combustion chamber, it should be understood that the principles elucidated herein may be also applied to combustion chambers having different configurations.

The foregoing description is provided for illustrative purposes only and should not be construed as in any way limiting this invention, the scope of which is defined solely by the appended claims.

I claim:

1. A combustion chamber for a gas turbine engine, the combustion chamber having a generally annular configuration about a central axis and having an outlet and being defined by inner and outer axial walls and an upstream end wall extending between the inner and outer walls, comprising:

a) a plurality of first fuel injectors to inject first sprays of fuel directly into the combustion chamber during a first operational mode of a gas turbine engine, the plurality of first fuel injectors arranged in inner and outer first fuel injector arrays about the central axis, the first fuel injectors of each array being circumferentially spaced apart and located such that the first fuel injectors of one first fuel injector array are disposed circumferentially between first fuel injectors of the other first fuel injector array;

b) a plurality of second fuel injectors to inject second sprays of fuel into the combustion chamber during a second operational mode of the gas turbine engine, the plurality of second fuel injectors arranged in inner and outer second fuel injector arrays about the central axis, the second fuel injector of each array being circumferentially spaced apart and located such that the second fuel injectors of one second fuel injector array are disposed circumferentially between second fuel injectors of the other second fuel injector array and c) first wall means extending axially into the combustion Chamber from the upstream end wall and having side edges attached to one of the inner and outer walls so as to define a plurality of chambers into which only the second fuel injectors inject fuel.

2. The combustion chamber of claim 1 wherein the inner first and second fuel injector arrays extend generally circularly about the central axis and have substantially equal radii.

3. The combustion chamber of claim 2 wherein the outer first and second fuel injector arrays extend generally circularly about the central axis and have substantially equal radii.

4. The combustion chamber of claim 3 wherein the arrays of first and second fuel injectors are oriented such that a first fuel injector and a second fuel injector are located on a line extending radially from the central axis.

5. The combustion chamber of claim 1 having an axial length L between the upstream end wall and the outlet, wherein the axial length Lw of the first wall means is between 0.15 L and 0.30 L.

6. The combustion chamber of claim 1 having an axial gas flow direction wherein the the first wall means extends substantially parallel to the axial gas flow direction.

7. The combustion chamber of claim 1 further comprising second wall means extending into the combustion chamber from the upstream wall spaced from and extending substantially parallel to the first wall means so as to define a space therebetween.

8. The combustion chamber of claim 7 further comprising swirl means operatively associated with each fuel injector so as impart a circular swirling movement to the fuel sprays emanating from each fuel injector.

9. The combustion chamber of claim 8 wherein the space between the first and second wall means communicates with an oxidizer supply and further comprising a plurality of first holes defined by the first wall mans so as to allow communication from the space between the first and second walls into the combustion chamber, the plurality of first holes oriented such that flow into the combustion chamber is in the same direction as the swirling fuel spray emanating from an adjacent fuel injector.

10. The combustion chamber of claim 9 further comprising a plurality of second holes defined by the second wall means so as to allow oxidizer communication from the space between the first and second wall means into the chamber defined by the first wall means, the plurality of second holes oriented such that flow into the chamber is generally in the same direction as the swirling fuel sprays located in the chamber.

11. The combustion chamber of claim 7 wherein the first wall means extends radially into the combustion chamber to substantially midway between the inner and outer fuel injector arrays.

* * * * *